US006034358A

United States Patent [19]

Higgins

[11] Patent Number: 6,034,358

[45] Date of Patent: Mar. 7, 2000

[54] RADIANT ELECTRIC HEATER

[75] Inventor: George Anthony Higgins, Stourbridge, United Kingdom

[73] Assignee: Ceramaspeed Limited, United Kingdom

[21] Appl. No.: 09/281,829

[22] Filed: Mar. 30, 1999

[30] Foreign Application Priority Data

Apr. 30, 1998 [GB] United Kingdom ..... 9809130

[51] Int. Cl.[7] ..... H05B 3/68

[52] U.S. Cl. ..... 219/462.1; 219/461.1

[58] Field of Search ..... 219/460.1, 461.1, 219/462.1, 463.1, 464.1, 468.1, 468.2; 126/90 A, 92 AC, 92 A

[56] References Cited

U.S. PATENT DOCUMENTS

| | | | |
|---|---|---|---|
| 4,161,648 | 7/1979 | Goessler | 219/461.1 |
| 4,639,579 | 1/1987 | Brooks et al. | 219/462.1 |
| 4,808,798 | 2/1989 | Goessler et al. | 219/462.1 |
| 4,910,387 | 3/1990 | McWilliams | 219/448.11 |
| 5,204,510 | 4/1993 | McWilliams et al. . | |
| 5,477,031 | 12/1995 | McWilliams | 219/461.1 |
| 5,517,002 | 5/1996 | Higgins | 219/462.1 |
| 5,908,571 | 6/1999 | Scott | 219/457.1 |

FOREIGN PATENT DOCUMENTS

| | | |
|---|---|---|
| 0176027 | 4/1986 | European Pat. Off. . |
| 2263379 | 7/1993 | United Kingdom . |
| 2287388 | 9/1995 | United Kingdom . |

OTHER PUBLICATIONS

Search Report Oct. 26, 1998.

*Primary Examiner*—Sang Paik
*Attorney, Agent, or Firm*—Ira S. Dorman

[57] ABSTRACT

A radiant electric heater includes a base (2) of insulation material and a lamp-form heating element (3) supported adjacent to a surface of the base. The lamp-form heating element is in the form of a filament (4) inside an elongate envelope (5). The surface of the base (2) is locally depressed (dished or ramped) beneath the envelope (5). A corrugated ribbon heating element (7) is supported on edge relative to the surface of the base (2). A portion of the corrugated ribbon heating element (7) crosses the at least one lamp-form heating element (3) beneath the envelope (5) and substantially conforms to the contour of the locally depressed surface and is free from contact with the envelope (5).

16 Claims, 2 Drawing Sheets

X — X

X — X

Z — Z

RADIANT ELECTRIC HEATER

This invention concerns radiant electric heaters particularly for use in cooking appliances such as glass-ceramic cooking appliances. The invention is particularly concerned with such heaters which incorporate one or more lamp-form heating elements together with one or more ribbon heating elements.

DESCRIPTION OF PRIOR ART

Radiant electric heaters are known which comprise a base layer of insulation material having supported adjacent thereto one or more lamp-form heating elements. The or each lamp-form heating element generally comprises a filament, such as of tungsten, inside an elongate envelope, such as of quartz glass, the elongate envelope being either straight or substantially circular. Such radiant electric heaters are known, for example, from European Patent Publication No. 0 176 027 in which a coiled wire heating element is additionally supported relative to the base in the region of the lamp-form heating element.

It is known additionally to provide one or more corrugated ribbon heating elements supported edgewise on the base layer. Such one or more ribbon heating elements may be arranged for electrical connection in series with the one or more lamp-form heating elements and may serve to damp inrush current through the latter when energised, such inrush current resulting from the large positive temperature coefficient of resistance of the filament material, such as tungsten.

With heaters of this construction there is a requirement for one or more portions of the one or more ribbon heating elements to cross the one or more lamp-form heating elements, particularly to allow electrical connection to terminal means at the edge of the heater. This has been solved hitherto by welding a wire or flat metal strip to the ribbon heating element and passing the wire or flat metal strip beneath the lamp envelope. This is disadvantageous since it requires an additional process step and unreliability can occur in the welded junction between the ribbon and the wire or flat strip.

OBJECT OF THE INVENTION

It is an object of the present invention to overcome or minimise this problem.

SUMMARY OF THE INVENTION

The present invention provides a radiant electric heater comprising a base of insulation material; at least one lamp-form heating element supported adjacent to a surface of the base, the at least one lamp-form heating element comprising a filament inside an elongate envelope, the surface of the base being locally depressed (dished or ramped) beneath the envelope; and at least one corrugated ribbon heating element supported on edge relative to the surface of the base, at least one portion of the at least one corrugated ribbon heating element crossing the at least one lamp-form heating element beneath the envelope with the at least one portion of the corrugated ribbon heating element substantially conforming to the contour of the locally depressed surface and being free from contact with the envelope.

The at least one portion of the at least one corrugated ribbon heating element may substantially conform to the contour of the locally depressed (dished or ramped) surface of the base by means of a corrugation pitch at one or more regions of the at least one portion of the at least one element having a different value at a location in the vicinity of the surface of the base from that at a corresponding location remote from the surface of the base.

The locally depressed (dished or ramped) surface of the base may be of substantially channel form, for example including sloping entry and exit sections, which may be curved or stepped.

The at least one portion of the at least one corrugated ribbon heating element may be arranged to cross the at least one lamp-form heating element beneath the envelope thereof at one or more regions of the envelope at which the filament therein is substantially inactive.

The base may comprise microporous thermal and electrical insulation material which may be provided in a dish-like support, such as of metal.

The at least one lamp-form heating element may comprise a tungsten filament inside a quartz glass envelope which may be sealed and may contain a halogenated atmosphere.

The elongate envelope of the at least one lamp-form heating element may be substantially straight or may be of a non-straight shape, including a substantially circular shape.

The at least one corrugated ribbon heating element may be provided with leg portions extending edgewise therefrom and at least partly embedded in the surface of the base.

The at least one corrugated ribbon heating element may be arranged for electrical connection in series with the at least one lamp-form heating element.

By means of the invention, the edgewise-supported at least one ribbon heating element is able to flex in its corrugations to descend on one side of the local depression in the surface of the base, to pass under the envelope of the at least one lamp-form heating element and to ascend on the other side of the local depression at the other side of the lamp-form heating element without contact with the envelope. The need for a separate wire or flat tape connecting link welded to the ribbon heating element and passing under the envelope of the lamp-form heating element is avoided.

The invention is now described by way of example with reference to the accompanying drawings in which:

DESCRIPTION OF PREFERRED EMBODIMENT

Figure 1:
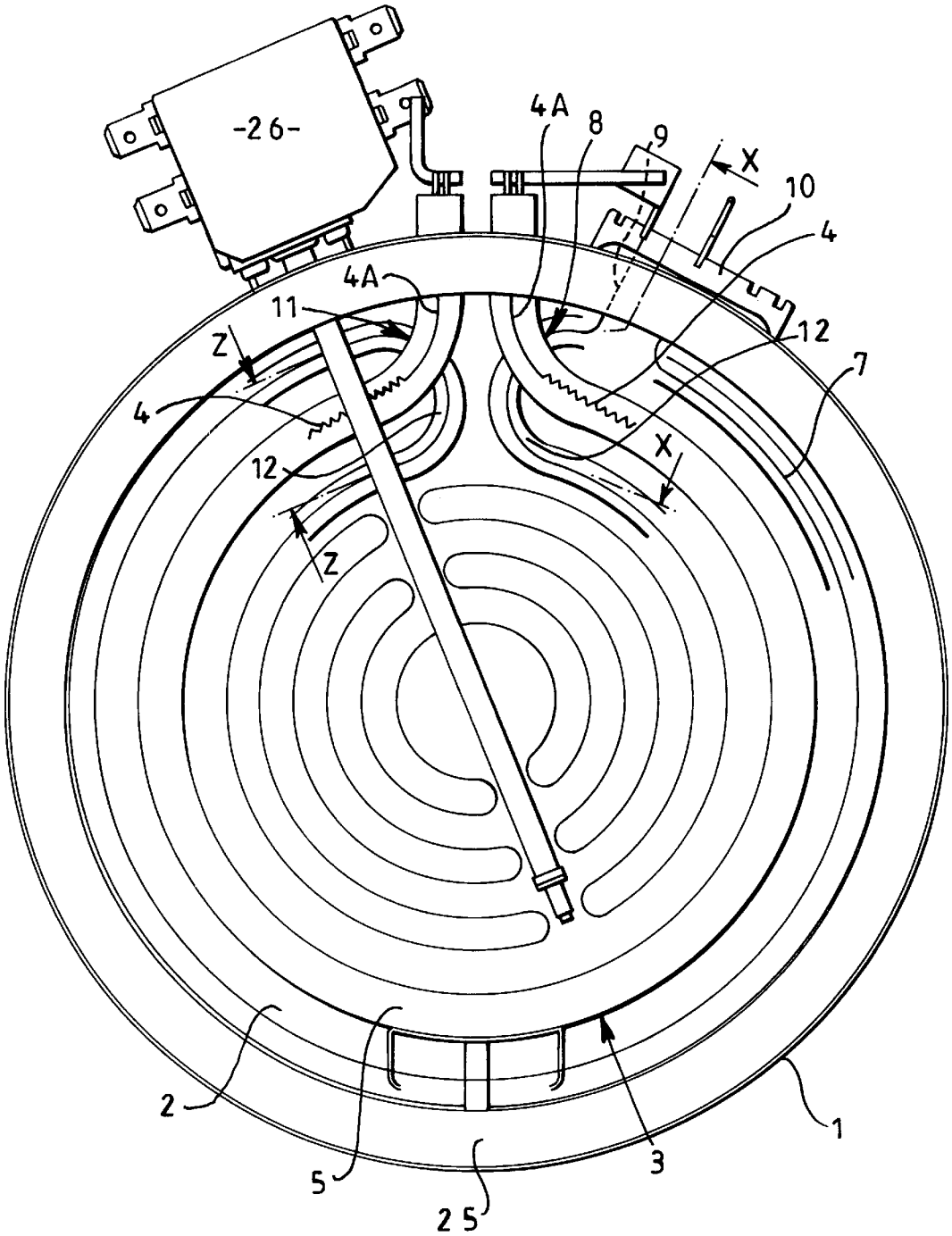
FIG. 1 is a plan view of a radiant electric heater according to the invention.

Referring to the drawings, a radiant electric heater comprises a metal dish-like support 1 containing a base 2 of insulation material, suitably comprising well-known compacted microporous thermal and electrical insulation material. A lamp-form heating element 3 is supported adjacent to a surface of the base 2. The lamp-form heating element 3 suitably comprises a tungsten filament 4 inside a substantially circular elongate envelope 5, suitably of quartz glass. The envelope is sealed and contains a halogenated atmosphere. A groove 6 is optionally provided underneath the lamp envelope.

A corrugated ribbon heating element 7 is supported on edge and partly embedded in the surface of the base 2. The ribbon heating element 7 is of known form and includes leg portions 7A integral therewith and extending edgewise therefrom and which are at least partly embedded in the surface of the base 2 for securing the ribbon heating element thereto.

More than one lamp-form heating element 3 and more than one corrugated ribbon heating element 7 may be provided in the heater if required. Shapes, other than circular, for the lamp-form heating element 3 may also be considered. For example, a substantially straight shape, or any other required shape, may be considered for the envelope 5.

The corrugated ribbon heating element 7 may serve as a ballast resistance element to damp inrush current through the filament of the lamp-form heating element when the latter is electrically energised for operation. For such purpose the ribbon heating element 7 is arranged to be electrically connected in series with the lamp-form heating element 3.

The heating elements 3 and 7 may, however, be arranged for independent operation in the heater.

The corrugated ribbon heating element 7 is required to cross the lamp-form heating element 3 beneath the envelope 5 thereof. Such crossing is required at region 8 to enable an end 9 of the ribbon heating element to be connected to a terminal block 10 at the edge of the heater. Crossing of the lamp-form heating element 3 is also required at region 11 to accommodate a reversal in the pattern arrangement of the corrugated ribbon heating element 7.

Regions 8 and 11 are advantageous crossing points because there the filament 4 is substantially inactive, being connected to terminations 4A. This minimises undesirable heating of the underlying ribbon heating element by the lamp-form heating element 3.

Figure 2A:
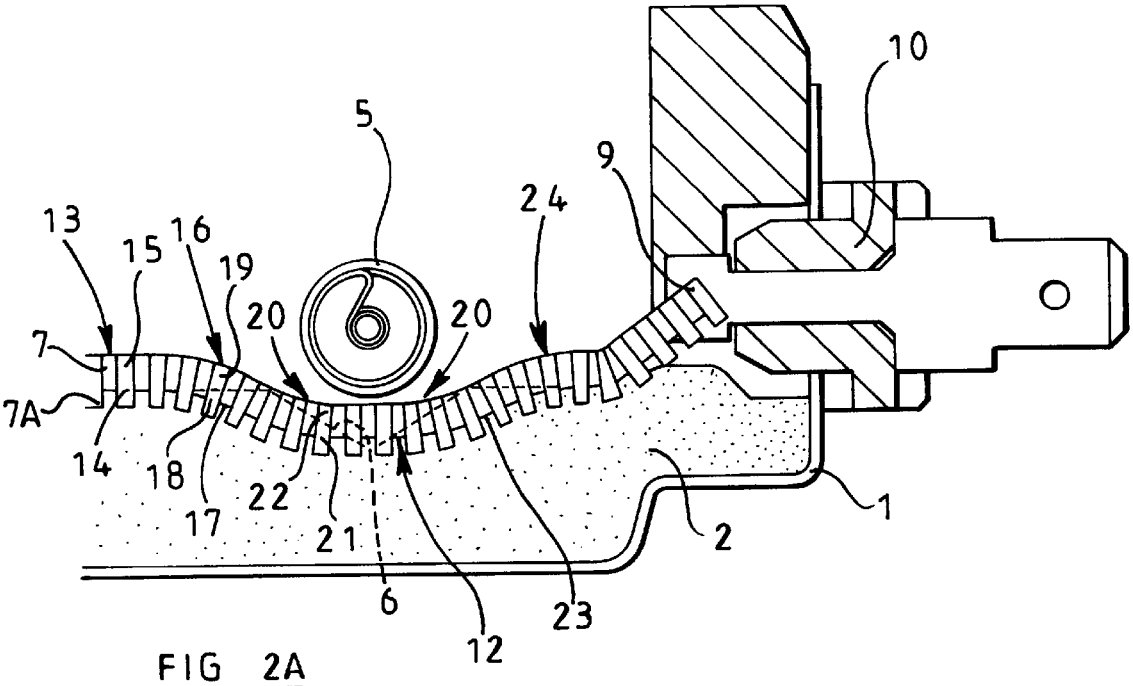
FIGS. 2A and 2B are cross-sectional views of the heater of FIG. 1.
Figure 2B:
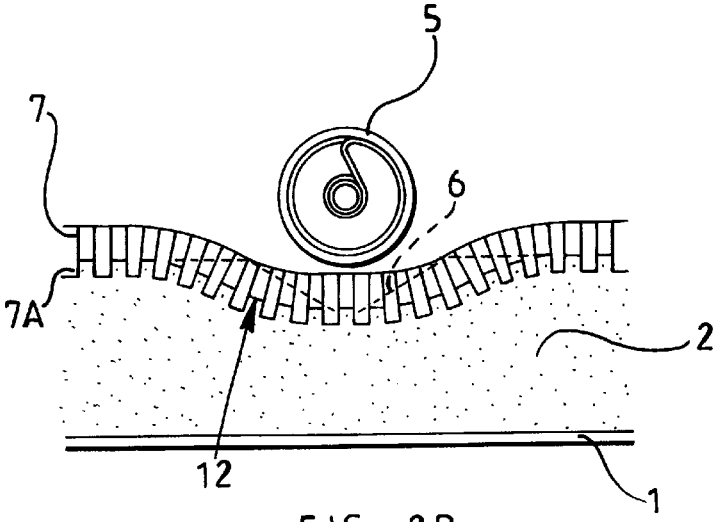

FIG. 2A shows how the crossing beneath the lamp envelope 5 at region 8 is achieved, the crossing under the lamp envelope 5 at region 11 being substantially the same and will not be separately described in detail, although illustrated in FIG. 2B.

The surface of the base 2 is locally depressed (dished or ramped) 12 beneath the envelope 5. Such locally depressed surface is conveniently of substantially channel form and includes sloping entry and exit sections which can be of curved or stepped form. A portion of the corrugated ribbon heating element 7 is partly embedded edgewise, by means of its leg portions 7A in the depressed surface 12, conforming to the contours of the surface and passing beneath the envelope 5 without contact therewith.

The corrugated ribbon heating element 7 is compliant and conforms to the contours of the locally depressed surface of the base by appropriate accommodation by the corrugations of the element. At region 13 of the ribbon heating element, the element is supported on a substantially planar major surface of the base 2 and the corrugations in the element have a corrugation pitch which is the same at a location 14 thereof adjacent to the surface of the base 2 as at a location 15 thereof remote from the surface of the base.

At region 16, the ribbon heating element is flexed to change from the planar major surface of the base and descend on the sloping section 17 of the locally depressed surface of the base. To accommodate the flexing, the corrugations change so that the corrugation pitch at a location 18 adjacent to the surface of the base 2 is smaller than the corrugation pitch at a corresponding location 19 remote from the surface of the base 2.

At region 20 of the ribbon heating element, flexing of the element in the opposite sense occurs. Here the corrugation pitch at a location 21 adjacent to the surface of the base 2 is larger than that at a corresponding location 22 remote from the surface of the base 2.

After passing under the envelope 5 of the lamp-form heating element at region 20, the ribbon heating element ascends on the sloping section 23 of the locally depressed surface of the base and is flexed at region 24 in a similar manner to that previously described with reference to region 16. After further flexing, the end 9 of the ribbon element is then connected to terminal block 10.

In manufacturing the heater, the ribbon heating element 7 is secured to the base 2 before the lamp-form heating element 3 is located in position. The base 2 is pre-formed with the required locally depressed region or regions and the ribbon heating element 7 is partly embedded in the surface of the base, including the one or more depressed surface regions, in a single operation using an appropriately-shaped press tool in which the element 7 is temporarily supported.

Alternatively, the base 2 can be pre-formed without the required locally depressed regions which are then formed during subsequent embedding of the ribbon heating element 7 using the press tool.

The lamp-form heating element 3 is then fitted to the heater.

A peripheral wall 25 of insulation material is provided on the heater and is arranged to contact the underside of a glass-ceramic cooking plate (not shown) of a smooth top cooking appliance.

A well-known form of temperature limiter 26 is also provided on the heater.

I claim:

1. A radiant electric heater comprising a base of insulation material; at least one lamp-form heating element supported adjacent to a surface of the base, the at least one lamp-form heating element comprising a filament inside an elongate envelope and the surface of the base being locally depressed beneath the envelope; and at least one corrugated ribbon heating element supported on edge relative to the surface of the base, at least one portion of the at least one corrugated ribbon heating element crossing the at least one lamp-form heating element beneath the envelope and transversely relative to a longitudinal direction of the envelope, with the at least one portion of the corrugated ribbon heating element substantially conforming to a contour of the locally depressed surface and being free from contact with the envelope, the at least one portion of the at least one corrugated ribbon heating element substantially conforming to the contour of the locally depressed surface of the base by means of a corrugation pitch, at least one region of the at least one portion of the at least one element having a different corrugation pitch at a location in the vicinity of the surface of the base from that at a corresponding location remote from the surface of the base.

2. A heater according to claim 1, wherein the locally depressed surface of the base is of substantially channel form, having sloping entry and exit sections.

3. A heater according to claim 2, wherein the sloping entry and exit sections are curved.

4. A heater according to claim 2, wherein the sloping entry and exit sections are stepped.

5. A heater according to claim 1, wherein the at least one portion of the at least one corrugated ribbon heating element is arranged to cross the at least one lamp-form heating element beneath the envelope thereof at least at one region of the envelope at which the filament therein is substantially inactive.

6. A heater according to claim 1, wherein the base comprises microporous thermal and electrical insulation material.

7. A heater according to claim 6, wherein the insulation material is provided in a dish-like support.

8. A heater according to claim 7, wherein the dish-like support comprises metal.

9. A heater according to claim 1, wherein the at least one lamp-form heating element comprises a tungsten filament inside a quartz glass envelope.

10. A heater according to claim 9, wherein the envelope is sealed.

11. A heater according to claim 10, wherein the envelope contains a halogenated atmosphere.

12. A heater according to claim 1, wherein the elongate envelope of the at least one lamp-form heating element is substantially straight.

13. A heater according to claim 1, wherein the elongate envelope of the at least one lamp-form heating element is of a non-straight shape.

14. A heater according to claim 13, wherein the non-straight shape comprises a substantially circular shape.

15. A heater according to claim 1, wherein the at least one corrugated ribbon heating element is provided with leg portions extending edgewise therefrom and at least partly embedded in the surface of the base.

16. A heater according to claim 1, wherein the at least one corrugated ribbon heating element is arranged for electrical connection in series with the at least one lamp-form heating element.

* * * * *